United States Patent [19]

La Bate

[11] 3,955,721

[45] May 11, 1976

[54] EXPENDABLE TUNDISH LINER

[76] Inventor: Micheal Donald La Bate, 115 Hazen Ave., Ellwood City, Pa. 16117

[22] Filed: Sept. 12, 1974

[21] Appl. No.: 505,494

[52] U.S. Cl. ..... 222/566; 266/280

[51] Int. Cl.[2] ..... B22D 41/02

[58] Field of Search ..... 266/43, 38, 39, 34; 164/53; 222/566, 46, 460

[56] References Cited

UNITED STATES PATENTS

| | | | |
|---|---|---|---|
| 1,681,943 | 8/1928 | Marshall | 266/43 UX |
| 3,006,046 | 10/1961 | Shephard, Jr. et al. | 266/43 X |
| 3,082,104 | 3/1963 | Belz | 164/53 X |
| 3,203,689 | 8/1965 | Hallowell, Jr. | 266/43 |
| 3,212,749 | 10/1965 | La Bate | 164/359 |
| 3,622,536 | 11/1971 | Ruddle et al. | 164/53 X |

*Primary Examiner*—Robert B. Reeves
*Assistant Examiner*—David A. Scherbel
*Attorney, Agent, or Firm*—Webster B. Harpman

[57] ABSTRACT

A liner for a molten metal receiving tundish in the form of appropriately sized and shaped inserts formed of insulating and/or exothermic containing materials replaces the usual brick lining of the metal tundish or may be installed thereover so that molten metal poured therein will not freeze or scull during the pouring or immediately thereafter by being kept out of contact with the metal tundish or the conventional refractory brick lining thereof. The liner acts to fully protect the tundish interior from molten metal contact or penetration. The inserts forming the liner are consumable at a predetermined rate and are expendible with each pour.

8 Claims, 4 Drawing Figures

EXPENDABLE TUNDISH LINER

BACKGROUND OF THE INVENTION

1. Field of the Invention

This invention relates to tundishes which are intermediate pouring vessels into which the molten metal from the tapping ladle is poured and from which steel may be poured into molds from one or two smaller nozzles in the vessel. Tundish pouring offers a greater opportunity for non-metallic inclusions to become separated from the metal, there is less splashing in the mold, better control of the pouring rate is obtained along with a reduction in pouring temperature.

2. Description of the Prior Art

Prior structures are the typically conventional tundishes formed as an open topped metal box with a refractory brick lining and one or more pouring nozzles in the bottom portion.

This invention provides a liner for the tundish in the form of preformed inserts of combustible material having a predetermined rate of consumability sufficiently long to complete a pour of molten metal.

SUMMARY OF THE INVENTION

Liners for tundishes in the form of expendible inserts of consumable material are disclosed for use in protecting the metal tundish and any refractory liner therein if present and to prevent molten metal poured in the tundish from freezing thereto. The inserts from which the liners are formed are insulating and/or exothermic and may additionally incorporate apertures for the insertion of external heating means. The inserts are shaped so as to be self retaining when positioned in the bottom of the tundish and against the walls thereof.

DESCRIPTION OF THE PREFERRED EMBODIMENT

Figure 1:
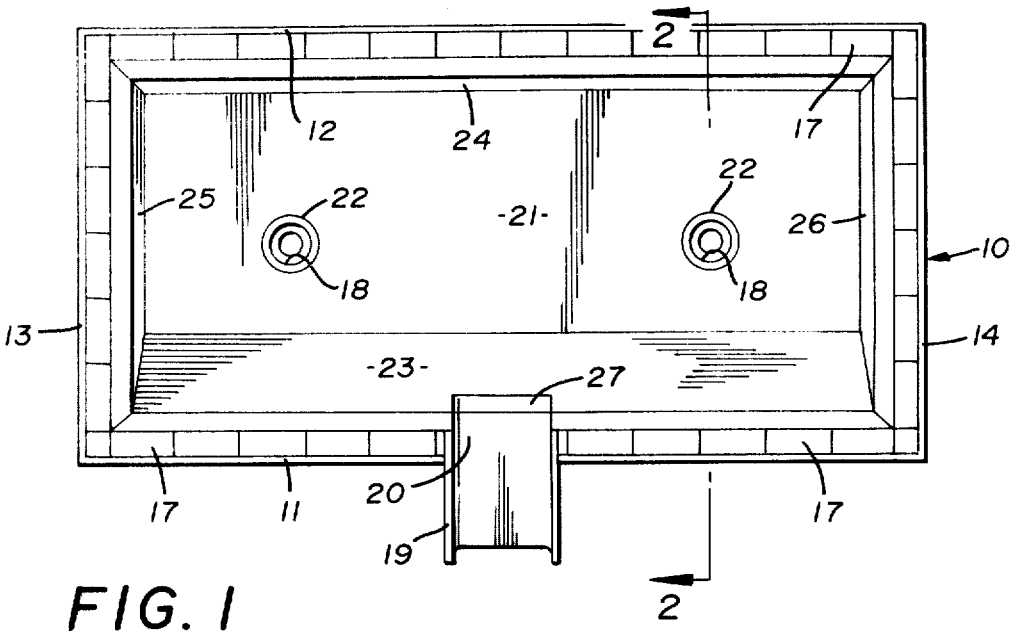
FIG. 1 is a top plan view of a tundish showing inserts forming a liner therein.
Figure 2:
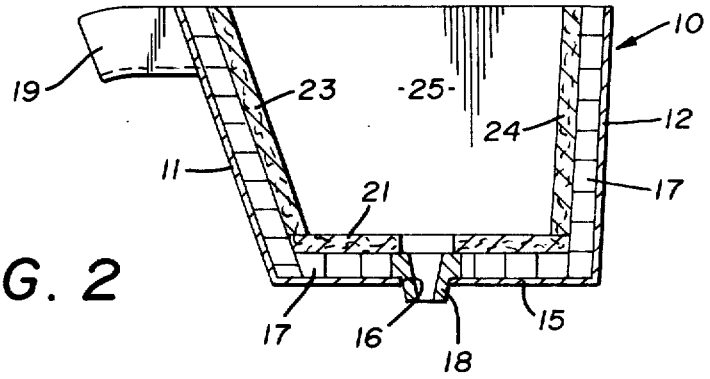
FIG. 2 is a horizontal section on line 2—2 of FIG. 1.

By referring to FIGS. 1 and 2 of the drawings it will be seen that a metal tundish 10 has front and back walls 11 and 12, end walls 13 and 14 and an integral bottom 15. The bottom 15 is apertured as at 16 and refractory bricks 17 are shown forming a liner on the inside of the front and back walls 11 and 12, the end walls 13 and 14 and the bottom 15. Refractory nozzles 18 are positioned in the apertures 16 and a spout 19 is formed in connection with a notch 20 in the upper edge of the front wall 11 of the tundish 10.

Those skilled in the art will recognize the tundish described so far as conventional.

Still referring to FIGS. 1 and 2 of the drawings, it will be seen that a horizontally disposed bottom insert 21 is positioned in the tundish on the refractory brick 17, apertures 22 being formed therein in registry with the refractory nozzles 18 heretofore referred to. Front and back wall inserts 23 and 24 respectively are positioned against the refractory brick 17 on the front and back walls 11 and 12 respectively and end inserts 25 and 26 are positioned against the refractory bricks 17 on the end walls 13 and 14 of the tundish.

The respective ends of the inserts 23, 24, 25 and 26 are mitered so that the inserts will be self-positioning and form a suitable liner covering all of the interior of the tundish. The insert 23 is notched as at 27 so as to conform with the notch 20 in the front wall 11 of the tundish 10 and the spout 19 in registry therewith.

The inserts 21, 23, 24, 25 and 26 are formed of a consumable material such as set forth in my U.S. Pat. No. 3,212,749 and comprising a mixture consisting essentially of about 15% by weight of sawdust, about 54% by weight of dolomite and about 31% by weight of sodium silicate. Alternately exothermic material may be present in such a mixture, the exothermically reactive material may comprise:

| | Percent |
|---|---|
| FeO | 10.50 |
| $Fe_2O_3$ | 36.30 |
| $SiO_2$ | 2.48 |
| MnO | .37 |
| CaO | 1.40 |
| MgO | 2.06 |
| Al | 24.48 |
| $Al_2O_3$ | 15.46 |
| CuO | 1.20 |
| NaCl | 5.75 |

Alternately the inserts may be formed of wood fiber, dolomite and silica with a typical mixture including silica in amounts between 50 and 80 percent, dolomite in amounts between 15 and 20 percent, wood fiber in amounts between 3 and 9 percent, mineral wool in amounts between 30 and 40 percent and pink clay in amounts between 2 and 6 percent by weight.

The inserts are of a thickness and density resulting in a desired rate of consumability, the thicknesses averaging one inch in a typical installation and the density of a typical insert being equivalent to that of a poured refractory. It is possible to line the tundish interior walls by ramming and forming the material directly thereagainst and without precasting the inserts. The typical weight of such material varies between 150 lbs. and 160 lbs. per cubic foot. Those skilled in the art will observe that the insulating inserts disclosed herein may be used as a lining in a tundish wherein the usual brick lining is not present. The inserts will fully protect the tundish interior from molten metal contact or penetration. It will further be observed that it is not necessary to preheat or fire or add temperature to the tundish before adding molten metal as the same is in contact only with the insulating inserts of the invention. It will further be observed that the addition of exothermic material to the insulating inserts enables the metal temperature to be maintained for a longer period of time than would otherwise be the case or until the casting or the pouring begins and when the pouring is finished the tundish can be dumped disposing of the remaining portions of the insulating inserts, cooled, relined with new inserts and repoured within a two to four hour period thus substantially reducing the number of tundishes required in a typical 24 hour cycle.

Figure 3:
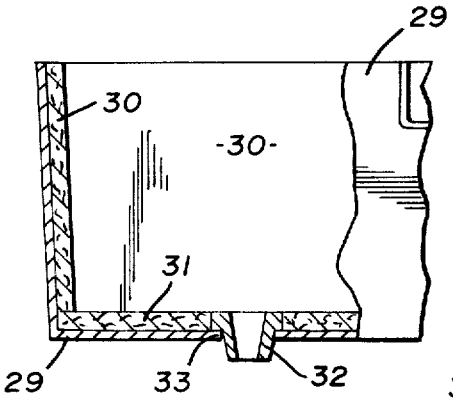
FIG. 3 is a side elevation of a portion of a tundish with parts broken away and parts in cross section and, FIG. 4 is a side elevation of a portion of a tundish with parts broken away and parts in cross section and illustrating auxiliary heating means therefor.

By referring now to FIG. 3 of the drawings a portion of a tundish may be seen with parts broken away and parts in cross section in which the metal tundish 29 has insulating and/or exothermic inserts 30 and 31 on the sidewalls and bottom thereof respectively positioned directly against the metal tundish 29. A refractory nozzle 32 is positioned in an opening 33 in the bottom of the tundish and FIG. 3 illustrates the use of the insulating and/or exothermic inserts of this invention forming a liner for a tundish without the usual refractory brick as hereinbefore described.

Figure 4:
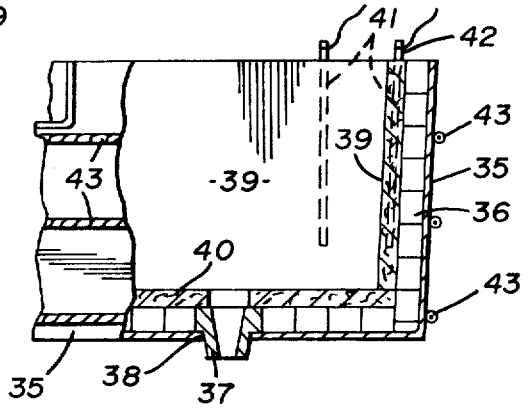

By referring now to FIG. 4 of the drawings, a modification of the tundish liner formed of insulating and/or exothermic containing inserts may be seen, the metal tundish 35 having a refractory brick lining 36, a pouring nozzle 37 in an opening 38 in the bottom thereof and inserts 39 and 40 positioned on the inner side walls and the bottom respectively. The side wall inserts 39 have openings 41 therein in which heating elements 42 may be positioned so that the temperature of the insulating and/or exothermic containing inserts 39 may be held at a desired temperature. Additionally or optionally coils 43 may be positioned around the exterior of the tundish 35 and resistance or induction heating realized thereby.

It will thus be seen that expendable liners for tundishes have been disclosed herein in the preferred form of the invention and means for increasing the temperature of the liners formed of such inserts has also been disclosed. The inserts from which the tundish liners are formed are capable of economic formation, distribution and rapid installation and their use substantially improves tundish pouring of molten steel and the like as hereinbefore set forth.

Having thus described my invention what I claim is:

1. A lined tundish for intermediate pouring of molten metal including an open topped apertured metallic vessel, a nozzle in said aperture, in which the liner comprises a protective expendible material covering the inner walls of said vessel and apertured for registry with said nozzle, said liner formed of a plurality of shaped inserts of combustible material having a known rate of consumability which is sufficiently long to complete a pour of molten metal.

2. The tundish of claim 1, said shaped inserts conforming in size with said inner walls for registry therewith.

3. The tundish of claim 1, said combustible consumable material of said inserts having exothermic material therein.

4. The tundish of claim 1, the combustible consumable material comprising a mixture consisting essentially of about 15 percent by weight of sawdust, about 54percent by weight of dolomite and about 31 percent by weight of sodium silicate.

5. The tundish of claim 1, the combustible material comprising a mixture consisting essentially of about 15 percent by weight sawdust, about 54 percent by weight of dolomite and about 31 percent by weight of sodium silicate and having exothermically reactive material added thereto in an amount sufficient to maintain a desired elevated temperature for a predetermined time.

6. The tundish of claim 1, wherein a refractory brick lining is present in said tundish and said liner inserts are positioned thereover.

7. The tundish of claim 1, the combustible material comprising a mixture consisting essentially of about 15 percent by weight of sawdust, about 54 percent by weight of dolomite and about 31 percent by weight of sodium silicate and having exothermically reactive material added thereto in an amount sufficient to maintain a desired elevated temperature for a predetermined time, said exothermically reactive material comprising:

| | Percent |
|---|---|
| FeO | 10.50 |
| $Fe_2O_3$ | 36.30 |
| $SiO_2$ | 2.48 |
| MnO | .37 |
| CaO | 1.40 |
| MgO | 2.06 |
| Al | 24.48 |
| $Al_2O_3$ | 15.46 |
| CuO | 1.20 |
| NaCl | 5.75. |

8. The tundish of claim 1, the combustible material comprising silica in an amount between 50 and 80 percent, dolomite in an amount between 15 and 20 percent, wood fiber in an amount between 3 and 9 percent, mineral wool in an amount between 30 and 40 percent and pink clay in an amount between 2 and 6 percent all by weight.

* * * * *

Notice of Adverse Decision in Interference

In Interference No. 99,836, involving Patent No. 3,955,721, M. D. LaBate, EXPENDABLE TUNDISH LINER, final judgment adverse to the patentee was rendered Dec. 6, 1979, as to claims 1, 2 and 6.

[*Official Gazette June 10, 1980.*]